US005997120A

United States Patent [19]

Ohde et al.

[11] Patent Number: 5,997,120

[45] Date of Patent: Dec. 7, 1999

[54] RECORDING APPARATUS WHICH ALLOWS INK AMOUNT DETECTION UPON EXCHANGE OF A PRINTHEAD

[75] Inventors: Takahiro Ohde, Yokohama; Osamu Asakura, Sagamihara; Masasumi Nagashima, Yokohama; Yoshiyuki Shimamura, Yokohama; Kenji Kawazoe, Yokohama; Kazuya Iwata, Yokohama; Seiji Takahashi, Yokohama; Yuji Kanome, Yokohama; Tetsuya Ishikawa, Yokohama, all of Japan

[73] Assignee: Canon Kabushiki Kaisha, Tokyo, Japan

[21] Appl. No.: 08/454,514

[22] Filed: May 30, 1995

[30] Foreign Application Priority Data

May 31, 1994 [JP] Japan ..... 6-119272

[51] Int. Cl.[6] ..... B41J 2/195

[52] U.S. Cl. ..... 347/7; 347/19

[58] Field of Search ..... 347/7, 19, 85, 347/86, 87

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/66 |
| 4,608,577 | 8/1986 | Hori | 347/66 |
| 4,639,738 | 1/1987 | Young et al. | 346/75 |
| 4,723,129 | 2/1988 | Endo et al. | 347/56 |
| 4,740,796 | 4/1988 | Endo et al. | 347/56 |
| 4,977,413 | 12/1990 | Yamanaka et al. . | |
| 5,051,759 | 9/1991 | Karita et al. | 347/7 |
| 5,068,806 | 11/1991 | Gatten et al. | 395/113 |
| 5,132,711 | 7/1992 | Shinada et al. | 347/6 |
| 5,136,305 | 8/1992 | Ims . | |
| 5,170,186 | 12/1992 | Shimamura et al. | 347/23 |
| 5,172,140 | 12/1992 | Hirabayashi et al. | 347/36 |

FOREIGN PATENT DOCUMENTS

| | | | |
|---|---|---|---|
| 0443245 | 8/1991 | European Pat. Off. | B41J 2/175 |
| 574182-A2 | 12/1993 | European Pat. Off. | 347/7 |
| 0587172 | 3/1994 | European Pat. Off. | G03G 15/08 |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 3058854 | 3/1991 | Japan | B41J 2/175 |

*Primary Examiner*—N. Le
*Assistant Examiner*—Craig A. Hallacher
*Attorney, Agent, or Firm*—Fitzpatrick, Cella, Harper & Scinto

[57] ABSTRACT

In a recording apparatus using a plurality of kinds of head cartridges each comprising an ink jet recording head and an ink tank formed as a unit, the present invention prevents, when a wrong head cartridge has been mounted during cartridge exchange, data regarding the remain of ink in a thitherto used cartridge of other kind from being lost, and enables the remain of ink in that cartridge to be confirmed. A user is pressed for the exchange of the head cartridge now mounted to thereby effect the exchange actually, and is called on to confirm whether the newly mounted head cartridge is a right one, and the initialization of the data regarding the remain of ink is effected when the user has done the inputting of the confirmation.

23 Claims, 11 Drawing Sheets

| FIG. 3A | FIG. 3B |
|---|---|

RECORDING APPARATUS WHICH ALLOWS INK AMOUNT DETECTION UPON EXCHANGE OF A PRINTHEAD

BACKGROUND OF THE INVENTION

1. Field of the Invention

This invention relates to a recording apparatus, and particularly to a construction for the control of the remain of a recording agent such as ink or toner used for recording or recording mediums such as recording sheets (these will hereinafter be generically referred to as the recording material).

2. Related Background Art

Recording apparatuses heretofore well known include, for example, recording apparatuses of the so-called serial type having a carrier carrying a recording head thereon and reciprocally movable in directions perpendicular to the direction of conveyance of a recording medium (hereinafter also referred to as the paper) such as paper or a sheet for OHP suitable for the projection by an overhead projector and excellent in transmitting property, and recording apparatuses of the full line type having a recording head of a length corresponding to the width of recording paper. In these recording apparatuses, use is made of recording heads using various recording systems, among which are generally widely known the wire dot system, the thermosensitive system, the heat transfer system, the ink jet system, the electrophotographic system, etc.

The recording agents used differ depending on these recording systems, and for example, ink is used as the recording agent in the ink jet system, toner is used as the recording agent in the electrophotographic system, and ink applied to an ink ribbon is used as the recording agent in the heat transfer system.

The amounts of the respective recording agents provided in the recording apparatuses are governed by members for holding these recording agents. For example, in the ink jet system, ink is held in an ink tank, but in the ink cartridge type comprising a recording head and an ink tank made integral with each other which has recently been spreading (hereinafter referred to as the head cartridge), the initial state thereof, namely, the amount held by the cartridge in its new state, is the amount of ink provided. The amount of ink held by the cartridge in its new state is substantially constant and the amount capable of recording is also substantially predetermined (hereinafter this amount will be represented as HMAX), and when the recording amount substantially reaches such a predetermined amount capable of recording, the replenishment of the recording agent such as ink becomes necessary. In this case, in the above-described head cartridge, the operation of exchanging it for a new head cartridge (hereinafter referred to as the new cartridge) becomes necessary.

As informing means for informing a user of the replenishment period for the recording agent such as ink or the exchange period for the new cartridge and the current remain capable of recording (hereinafter referred to as the remain), many means are known such as means for continuously counting the used amount or the remain and indicating a message or the like on an indicating device on the basis of the counted value, means of providing a window or the like for confirmation to thereby enable the user to visually confirm, and indicator means corresponding to the remain of the ink or the like and variable with an increase or a decrease in the remain.

Also, many constructions for the detection of the remain of recording mediums are known in the art of copying apparatuses, printers, etc.

However, in the above-described example of the prior art wherein the control of the remain is effected with the used amount or the remain counted, when the counted value of the used amount or the remain stored in the recording apparatus body is changed, for example, by the exchange of the head cartridge, the informed substance is also changed simultaneously therewith. Therefore, for example, in a recording apparatus of a construction in which discrete head cartridges are used for monochrome recording and for color recording and recording is effected with the respective head cartridges exchanged and mounted in the recording apparatus, when in case of the exchange of the head cartridge, the head cartridge is erroneously exchanged for a new cartridge for color instead of a new cartridge for monochrome, the counted value of the used amount or the remain in the head cartridge for color recording is changed and simultaneously therewith, the informed substance is also changed. This has led to the problem that even if the user becomes aware of the error after the exchange, the information on the head cartridge for color recording so far used has all been changed and therefore the correct counted value of the used amount or the remain regarding that head cartridge disappears and it becomes impossible to grasp it.

SUMMARY OF THE INVENTION

The present invention has been made in order to solve the above-noted problem and an object thereof is to provide a recording apparatus in which even when a head cartridge or the like containing a recording agent therein is erroneously exchanged for a new one, it is possible to grasp the used amount or the remain of another recording agent so far used.

Another object of the present invention is to provide a recording apparatus for effecting recording by the use of recording means, comprising:

- recording material holding means holding therein a recording material to be consumed by recording in said recording apparatus and removably mounted in said recording apparatus;
- detecting means for detecting the amount of the recording material held in said recording material holding means mounted in said recording apparatus;
- memory means for memorizing the amount of the recording material detected by said detecting means;
- input means for enabling a user to effect predetermined inputting; and
- changing means for changing the content of said memory means in conformity with the amount of the recording material held in said recording material holding means after the predetermined inputting has been effected by said input means when said recording material holding means has been mounted in said recording apparatus.

Still another object of the present invention is to provide a method of controlling the remain of a recording material in a recording apparatus provided with recording means for effecting recording, and recording material holding means holding therein the recording material to be consumed by recording and removably provided, comprising the steps of:

- pressing a user for the removal of said recording material holding means; and
- renewing information about the amount of the recording material remaining in said recording material holding means when after the removal of said recording material holding means, new recording material holding means is mounted and predetermined inputting by the user has been effected.

According to the construction of the present invention, when recording material holding means such as a head cartridge has been erroneously exchanged, the memory content regarding the amount of recording material held by the recording material holding means so far used is not immediately changed, but is changed in accordance with the amount of recording material in new holding means only after a user has become aware of erroneous mounting by an informed content and inputting after the confirmation of the mounting of right holding means has been effected.

DESCRIPTION OF THE PREFERRED EMBODIMENTS

Some embodiments of the present invention will hereinafter be described in detail with reference to the drawings.

Figure 1:
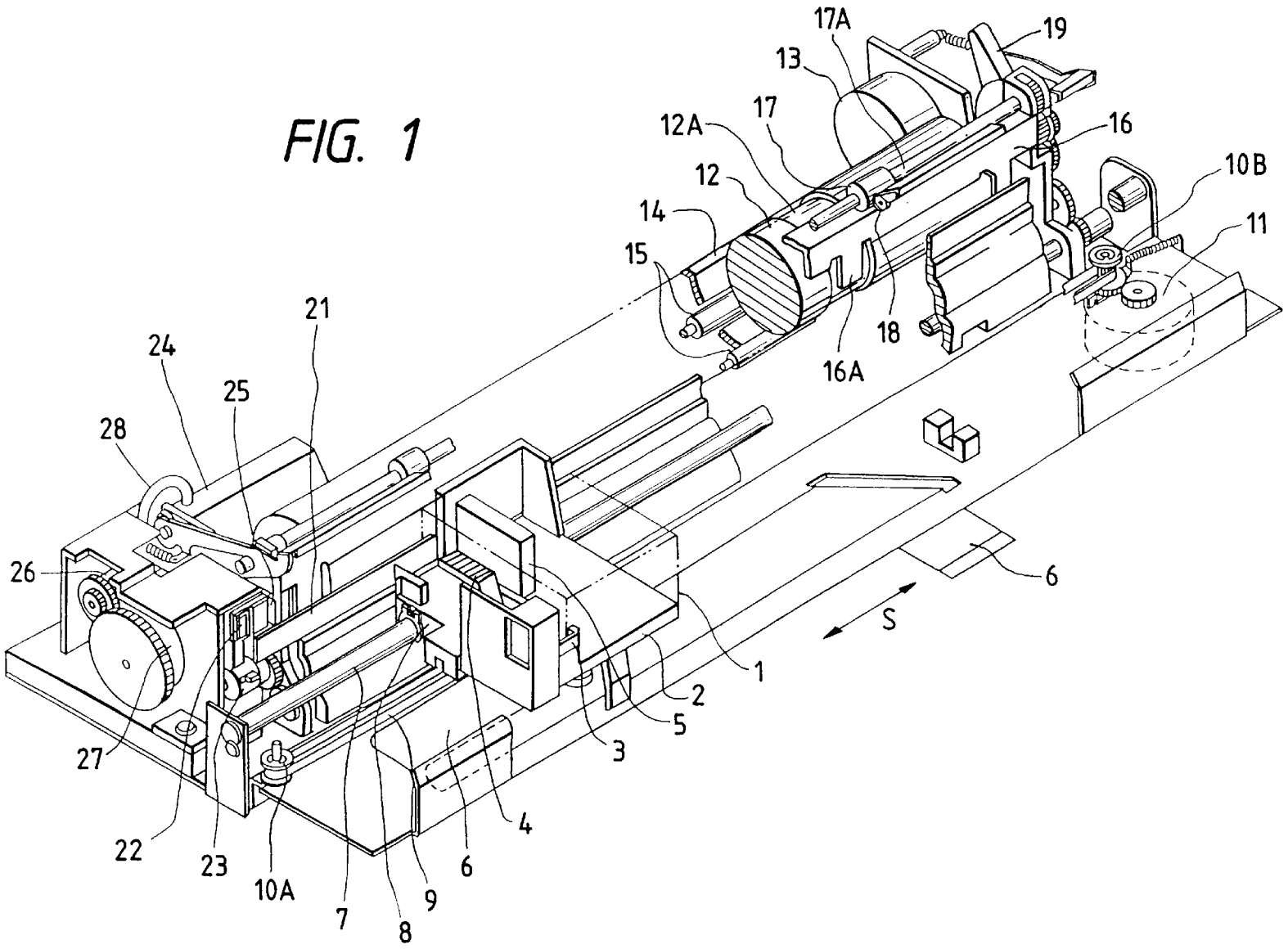
FIG. 1 is a pictorial perspective view schematically showing the construction of an ink jet recording apparatus according to an embodiment of the present invention.

FIG. 1 is a perspective view schematically showing the construction of a recording apparatus according to an embodiment of the present invention.

In FIG. 1, a head cartridge 1 indicated by dot-and-dash line has an ink jet head and an ink tank as a unit. This head cartridge carries thereon a head cartridge for monochrome during monochrome recording, and a head cartridge for color during color recording, and it is desirable that the head cartridge not in use be kept in a custody box, not shown, to maintain the discharge state of ink. The reference numeral 2 designates a carrier carrying the head cartridge 1 thereon and movable in the direction of arrow S in FIG. 1. The reference numeral 3 denotes a hook for mounting the head cartridge 1 on the carrier 2, the reference numeral 4 designates a lever for operating the hook 3, and the reference numeral 5 denotes a support plate for supporting an electrical connecting portion to the head cartridge 1. The reference numeral 6 designates an FPC (flexible print circuit) for connecting the electrical connecting portion and a body control portion together. The reference numeral 7 denotes a guide shaft for guiding the carrier 2. The guide shaft 7 is inserted in the bearing 8 of the carrier. The reference numeral 9 designates a timing belt connected to the carrier for transmitting a drive force for moving the carrier in the direction of arrow S. The timing belt 9 is passed over pulleys 10A and 10B disposed on the opposite side portions of the apparatus. A drive force is transmitted from a carrier motor 11 to one of these pulleys, 10B, through a transmission mechanism such as a gear.

The reference numeral 12 denotes a conveying roller for regulating the recording surface of a recording medium such as paper and for conveying the recording medium by being rotated. The conveying roller 12 is rotatively driven by a conveying motor 13. The reference numeral 14 designates a paper pan for directing the recording medium to a recording position. The reference numeral 15 denotes pinch rollers disposed in the conveyance path of the recording medium for urging the recording medium toward the conveying roller 12 and conveying the recording medium. The reference numeral 16 designates a platen opposed to the discharged port of the head cartridge 1 for regulating the recording surface of the recording medium. The reference numeral 17 denotes a paper discharging roller disposed downstream of the recording position with respect to the direction of conveyance of the recording medium for discharging the recording medium toward a paper discharge port, not shown. The reference numeral 18 designates a spur provided correspondingly to the paper discharging roller 17 for urging the recording medium against the paper discharging roller 17 and creating a conveying force for the recording medium by the paper discharging roller 17. The reference numeral 19 denotes a release lever for releasing the biasing of the pinch rollers 15 and spur 18 during the setting or the like of the recording medium.

The platen 16 has its opposite sides rotatably supported by the shaft of the paper discharging roller 17, and is biased from the stopped position of right and left plates 20 toward the front surface portion 21 of the paper pan 14, and a portion 16A thereof urges the conveying roller 12 in the portion 12A thereof made smaller than the outermost periphery thereof.

The reference numeral 22 designates a cap formed of an elastic material such as rubber and opposed to the ink discharge port forming surface of the recording head of the head cartridge 1 and supported for movement into contact with and away from the recording head. This cap 22 is used for the protection of the recording head during non-recording and used in case of the discharge recovering process of the recording head. The discharge recovering process includes the process of opposing the cap 22 to the discharge port forming surface, and driving an energy generating element provided in the discharge port and utilized for ink discharge, to thereby discharge ink from the discharge port and thereby eliminate unsatisfactory discharge factors such as bubbles and dust or ink increased in viscosity and having become unsuitable for recording (preliminary discharge), and the process of forcing the ink to be discharged from the discharge port with the discharge port forming surface covered with the cap 22 to thereby eliminate the unsatisfactory discharge factors (suction recovery). The reference numeral 23 denotes a pump having a suction force and used to such the ink received into the cap 22 during the suction recovering process by the above-described forced discharge and during the discharge recovering process by the preliminary discharge. The reference numeral 24 designates a waste ink tank for storing therein waste ink sucked by the pump 23. The waste ink tank 24 is connected to the pump 23 by a tube 28. The reference numeral 25 denotes a blade for wiping the discharge port forming surface of the recording head. The blade 25 is supported for movement to a position in which it protrudes to the head side and effect wiping in the process of movement of the carrier and a retracted position in which it is not engaged with the discharge port forming surface. The reference numeral 26 designates a recovery system motor, and the reference numeral 27 denotes a cam device for receiving the drive force from the recovery system motor 26 to thereby effect the driving of the pump 23 and the movement of the cap 22 and the blade 25.

Figure 2:
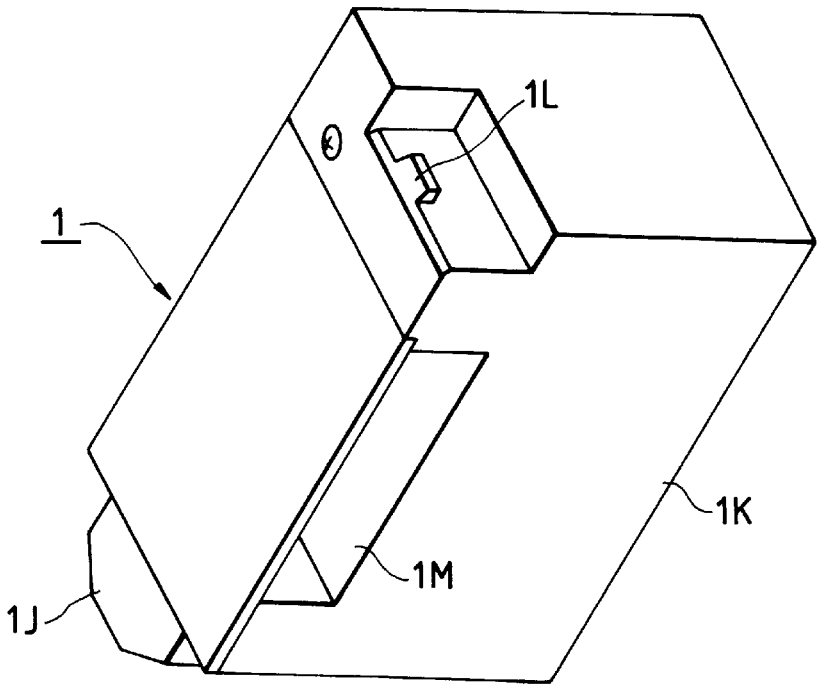
FIG. 2 is a pictorial perspective view of a head cartridge used in the apparatus of FIG. 1.

FIG. 2 is a pictorial perspective view showing the details of the above-described head cartridge 1.

The head cartridge 1 comprises a discharge unit 1J forming a recording head body and an ink tank 1K formed integrally therewith. A pawl 1L is restrained by the hook 3 provided on the carrier 2 when the head cartridge 1 is mounted on the carrier 2. As is apparent from FIG. 2, the pawl 1L is disposed inside the whole extension of the external appearance of the head cartridge. Although not shown in FIG. 2, a dash portion for positioning is provided near the discharge unit 1J forwardly of the head cartridge 1. A head opening portion 1M is for the insertion thereinto of the support plate 5 (see FIG. 1) provided upright on the carrier 2 and supporting a flexible substrate (an electrical connecting portion and a rubber pad).

Figures 3, 3A:
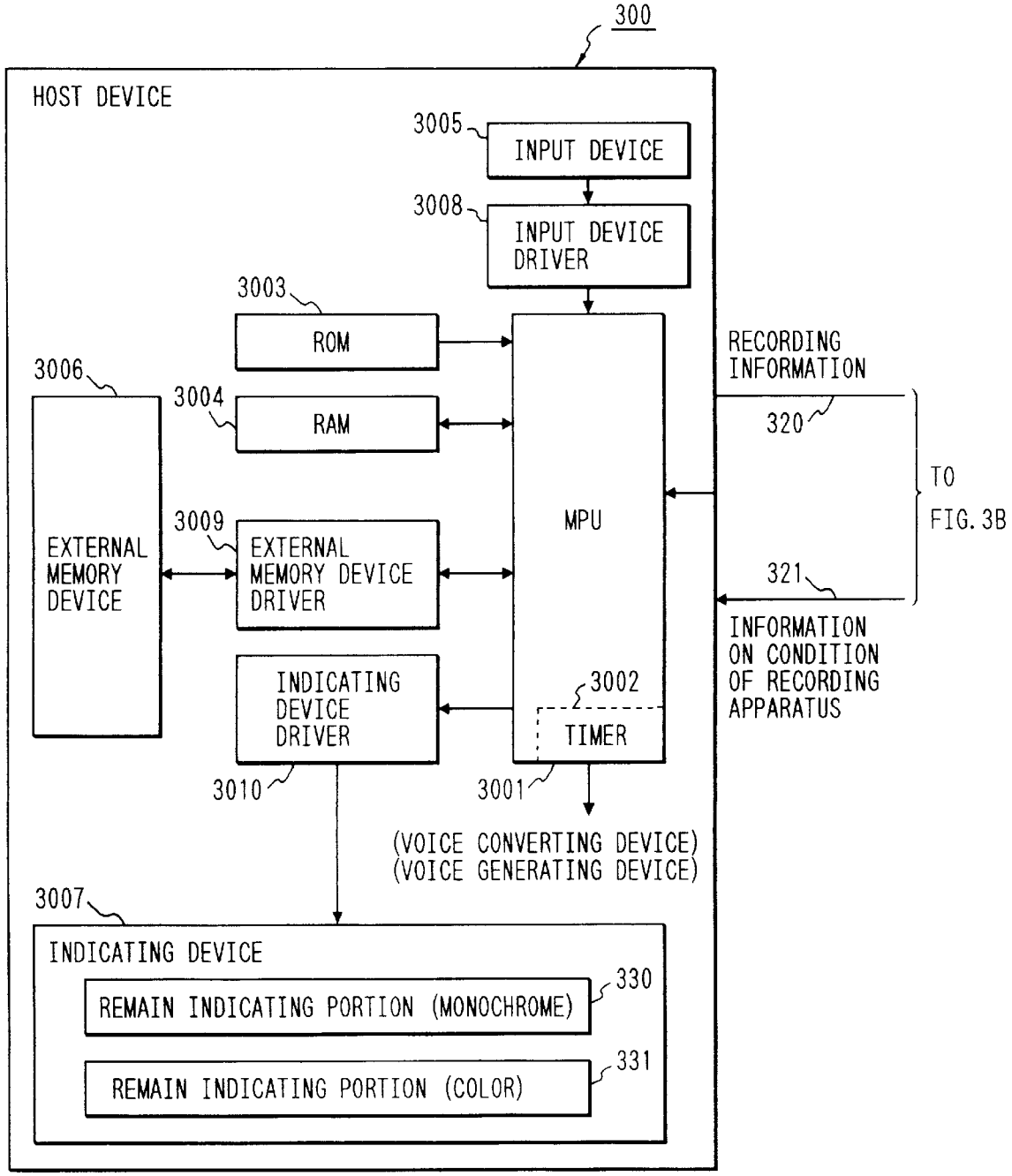
FIG. 3 is comprised of FIGS. 3A and 3B showing block diagrams of the control construction of the recording apparatus of FIG. 1.
Figure 3B:
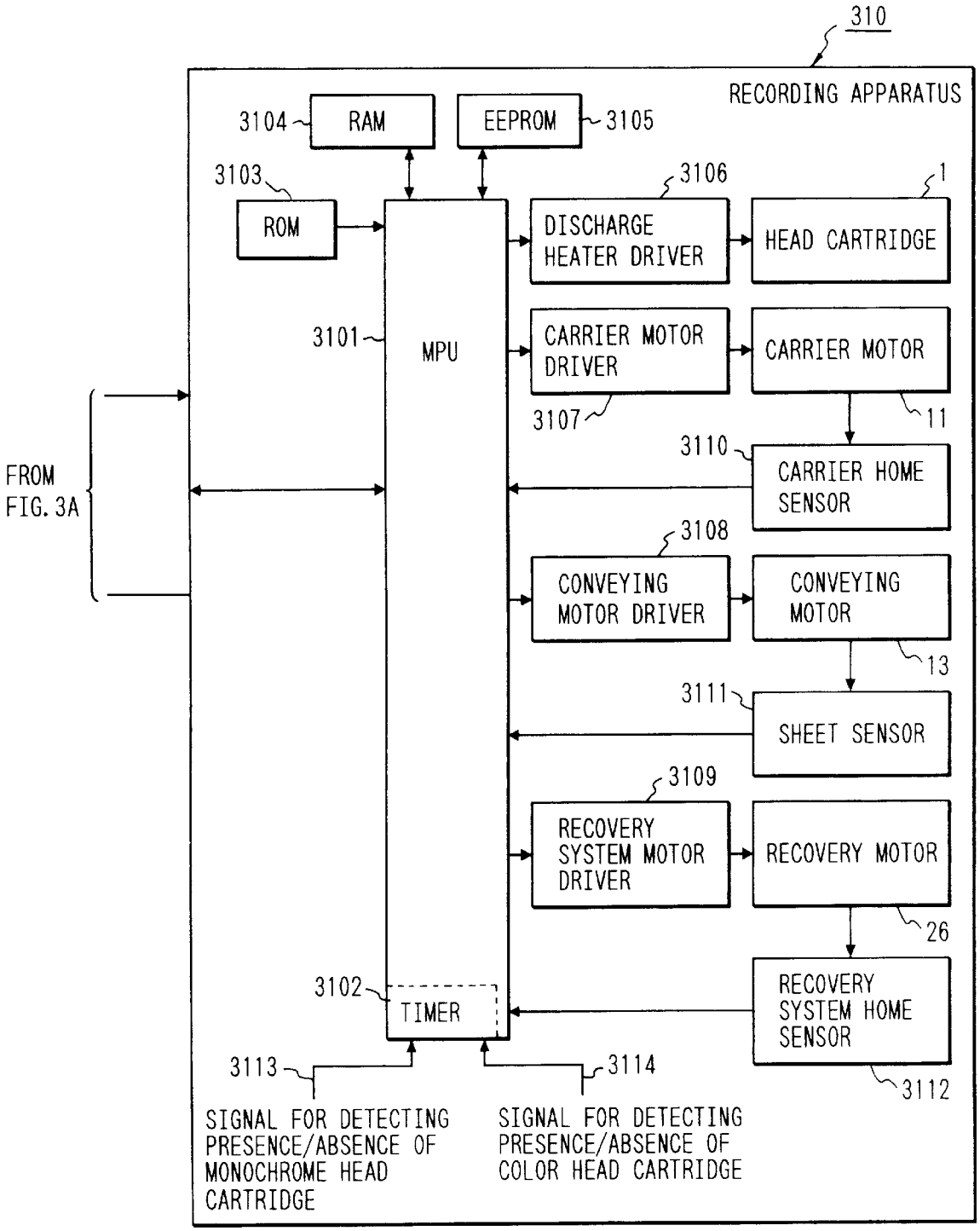

FIGS. 3A and 3B are block diagrams showing the control construction of the recording apparatus according to a first embodiment of the present invention.

In FIG. 3A, the reference numeral 300 designates a host apparatus such as a computer or a word processor. The reference numeral 3001 denotes an MPU which governs the control of the whole of the host apparatus 300 and which has a timer portion 3002 controlling the time for the execution of control. The host apparatus 300 is controlled on the basis of a control program and various data stored in an ROM 3003 or an external memory device 3006 such as a floppy disc or a hard disc. The reference numeral 3004 designates an RAM used as a work area or a buffer area or the like for storing therein input data from an input device 3005 such as a keyboard during the execution of control. The reference numeral 3007 denotes an indicating device such as a CRT or an LCD. The reference numerals 3008, 3009 and 3010 designate drivers for effecting the control or driving of the input device 3005, the external memory device 3006 and the indicating device 3007, respectively.

A recording apparatus 310, like the host apparatus 300, has an MPU 3101 for effecting the control of the recording apparatus, a timer portion 3102, an ROM 3103 and an RAM 3104. EEPROM 3105 in the recording apparatus 310 is an electrically erasable ROM and can hold recorded data therein even when the power source of the apparatus is cut off. In the present embodiment, the used amount or remain of ink as the recording material is stored in this EEPROM 3105.

During recording, recording information 320 transmitted from the MPU 3001 of the host apparatus 300 is stored in the RAM 3104 of the recording apparatus 310. Thereafter, the various portions of the recording apparatus 310 are controlled by the MPU 3101 and the timer portion 3102 to thereby effect recording. That is, during the recording in the recording apparatus 310, ink discharge in the head cartridge 1 is controlled by the MPU 3101 through a discharge heater driver 3106, and the carrier motor 11, the conveying motor 13 and the recovery system motor 26 are driven and controlled through respective motor drivers 3107, 3108 and 3109. Also, the MPU 3101 detects the position of the carriage 11, the presence or absence of paper and the position of the cap on the basis of the detection by a carrier home sensor 3110, a paper sensor 3111 and a recovery system home sensor 3112.

In the RAM 3104, there are stored, besides the above-mentioned recording information, MD11 which is data consisting of a cumulation of the number of the recording dots of the head cartridge for monochrome now mounted (now used), data CD11 consisting of a cumulation of the number of the recording dots of the head cartridge for color, and data HD used when the head cartridge now mounted is recognized. Also, in the RAM 3004 of the host apparatus 300, there are stored data MDD indicative of the remain of ink in the head cartridge for monochrome now mounted (now used), and data CDD indicative of the remain of ink in the head cartridge for color. MDD and CDD are used when the remains in the respective cartridges are indicated. Also, in the EEPROM 3105, there are prepared areas for storing the above-mentioned data MD11 and CD11 therein. Areas for storing these data will hereinafter be referred to as RMD11, RCD11, RHD, RMDD, RCDD, EMD11 and ECD11.

Also, on the indicating device 307 of the host apparatus 300, the remains of monochromatic ink and color ink based on the data MDD and CDD indicative of the remains in the respective cartridges are discretely indicated as remain indicators (330 and 331) which will be described later. This indication is effected in the following manner. The recordable dot number HMAX of a new head cartridge is prestored in the ROM 3103, and the cumulative recording dot numbers MD11 and CD11 of the head cartridge for monochrome or the head cartridge for color now used are successively counted and the difference therebetween (HMAX-MD11) or (HMAX-CD11) is transmitted as the state information 321 of the recording apparatus to the host apparatus 300. Those values, i.e., MDD and CDD, are stored in the RMDD and RCDD of the RAM 3004, and on the basis thereof, the remains are indicated on the indicating device 3007. Also, when besides recording, there is, for example, a discharge recovering process or the like as a factor which varies the remain of ink, the amount fluctuated by such operation is also converted into a cumulative recording dot number.

The cumulative dot numbers MD11 and CD11 counted in this manner are stored in the EMD11 and ECD11, respectively, of the EEPROM 3105 when the power source of the apparatus is OFF, and are again stored in the RMD11 and RCD11 of the RAM3104 after the power source of the apparatus becomes ON and therefore, are always held irrespective of the ON or OFF of the power source.

Figure 4:
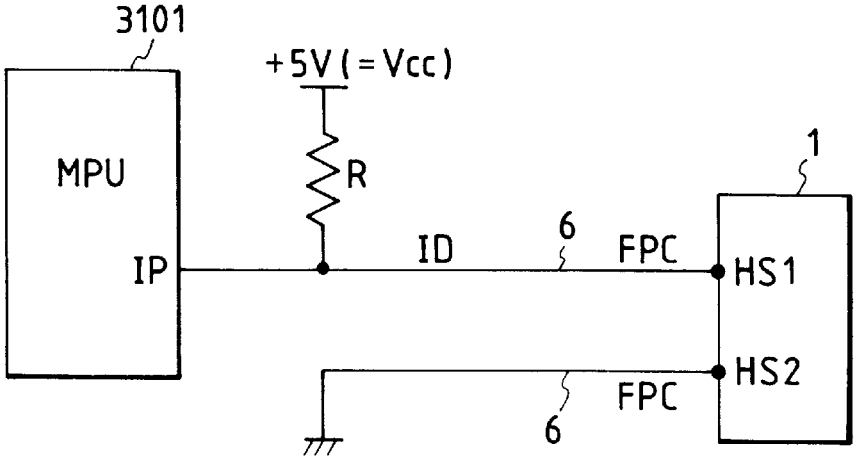
FIG. 4 is a circuit diagram showing a circuit for detecting the presence or absence of the mounting of the head cartridge in the control construction of FIG. 3.

FIG. 4 is a circuit diagram showing an example of a circuit construction for detecting the presence or absence of the mounting of the head cartridge 1.

One end of a mount presence-absence detection signal ID shown in FIG. 4 is connected through FPC6 to a portion HS1 on which the head cartridge 1 is to be mounted, and when the head cartridge 1 is mounted, the portion HS1 conducts to a portion HS2 connected to the gland (GND) of the body control portion through the conductive portion of the head cartridge 1. The other nd of the signal ID is connected to an input terminal P of which the H and L levels can be detected by the PU 3101 and to one end of a resistor R. The other end of the resistor R is connected to the power source (VCC) of the body control portion.

With the construction as described above, when the head cartridge 1 is not mounted on the carrier 2, the input terminal IP has its H level detected, and when the head cartridge 1 is mounted on the carrier 2, the input terminal IP has its L level detected. This circuit construction is provided correspondingly to each of the head cartridge for monochrome and the head cartridge for color and therefor, it becomes possible to effect the detection of the respective head cartridges individually. This is inputted to the MPU 3101 which is a control portion, as indicated by a monochrome head cartridge mount presence-absence detection signal 3113 and a color head cartridge mount presence-absence detection signal 3114 in FIG. 3B.

Figure 5:
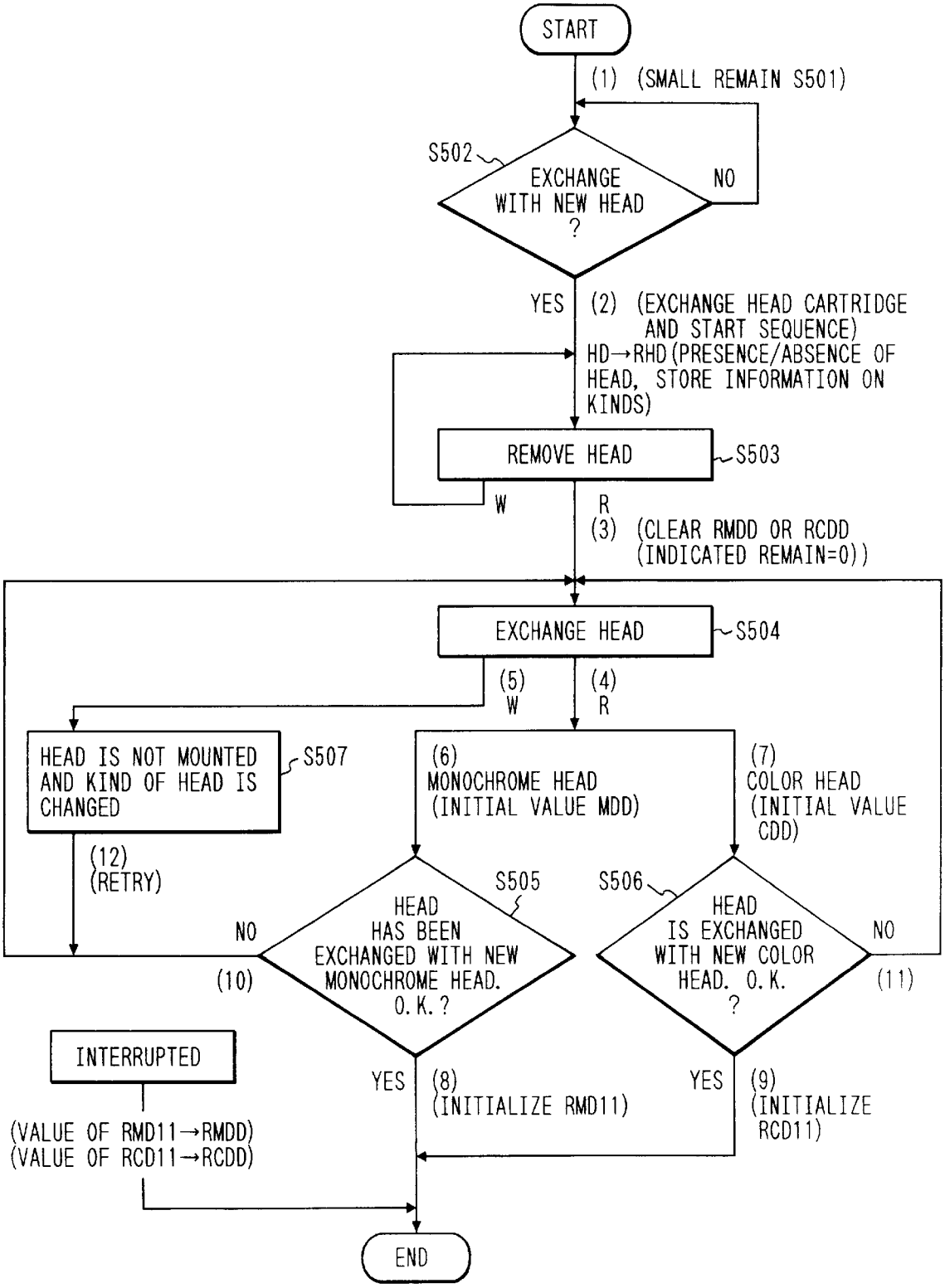
FIG. 5 is a flow chart showing an instruction procedure to a user and an interval control sequence during the exchange of a head cartridge according to an embodiment of the present invention.
Figure 6:
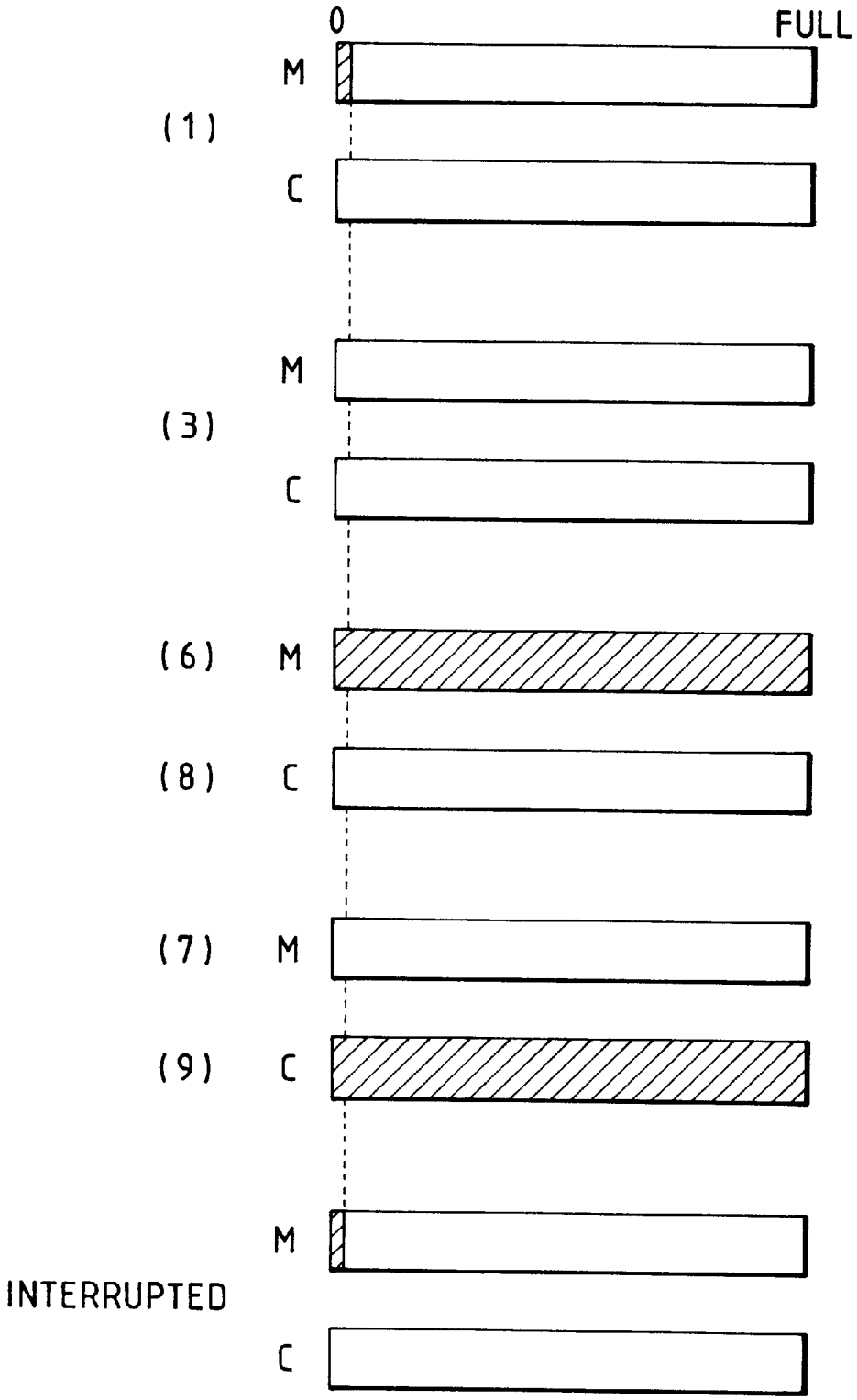
FIG. 6 is a schematic diagram showing the indication by an ink remain indicator corresponding to the sequence of FIG. 5.

FIG. 5 is a flow chart showing an instruction procedure to a user during the exchange of the head cartridge in the present embodiment and an internal control sequence, and FIG. 6 is a schematic diagram showing the indication by remain indicators in the procedure of FIG. 5. In FIG. 5, "R" represents the right termination of the operation and "W" represents the wrong termination of the operation or the non-termination of the operation. Also, in FIG. 6, the indicator indication represents the remain in the form of a bar graph, and "M" is indicative of the monochrome head cartridge and "C" is indicative of the color head cartridge. The following description will be made with respect to a case where with a monochrome head cartridge mounted in the recording apparatus, a new color head cartridge has been erroneously mounted in an attempt to exchange the monochrome head cartridge for a new monochrome head cartridge, but a similar way of thinking is also passive in a converse case.

When the user recognizes by remain indicators shown as remain indicating portions 330 and 331 or by message indication that as represented by (1) in FIGS. 5 and 6, the remain is small (this is a case where the remain in the monochrome head cartridge is slight), he selects the key "new head cartridge exchange" of the input device 3005. In conformity with this, a head cartridge exchange sequence is started as shown by (2) in FIG. 5, and information HD indicative of the presence or absence and kind of the head cartridge being mounted is first detected by the circuit shown in FIG. 4 and is stored in RHD. In this case, the presence of a monochrome head cartridge is detected. Subsequently, at a step S503, a message to the effect that the cartridge is to be removed is indicated, and when it is detected by the circuit shown in FIG. 4 that the head cartridge has been removed, corresponding one of RMDD and RCDD is initialized and the remain indication, i.e., informed content, is cleared. In this case, RMDD is cleared as shown by (3) in FIG. 5. Thereafter, at a step S504, a message to the effect that the head cartridge should be exchanged is indicated. When as shown by (2) in FIG. 5, it is detected at the start of the head cartridge exchange sequence that the head cartridge is not mounted, the indicating process of the step S503 is omitted, but the information is stored in RHD at a point of time whereat the recording head has been removed.

Next, when the kind of the mounted head cartridge is detected by the circuit shown in FIG. 4, for example, a color head cartridge is mounted erroneously and this is detected, CDD of a value corresponding to the remain indication, i.e., the informed content HMAX, is stored in RCDD in conformity with the mounting of the color head cartridge. In this case, as shown by (7) in FIG. 5, MAX value is stored in RCDD. However, the value stored in RMD11 and RCD11, i.e., the counted cumulative recording dot number, is not initialized but is left as it is. After the remain indication, i.e., the informed content, has been made MAX, at a step S506, a message to the effect that cartridge exchange has been terminated is outputted and the user is called upon to confirm it.

Here, the remain indication of the color head cartridge exhibits MAX value and therefore, the user becomes aware of having erroneously mounted the color head cartridge, and when he effects a predetermined input to make correction, return is made to the procedure of the step S504.

When by the above-described procedure, a right head cartridge is finally mounted and at a step S505 or S506, YES is selected and inputted, the value of RMD11 or the value of RCD11 is initialized for the first time at this point of time. In this case, as shown by (8) in FIG. 5, the value of RHD11 is initialized.

Also, when the exchange is to be interrupted, an "interrupt" key is selected, whereby the values of RMD11 and RCD11 are again stored in RMDD and RCDD, respectively, in conformity with the information HD at the start of the head cartridge exchange sequence. By this procedure, it becomes possible for the remain indication, i.e., the informed content, to be restored to the remain indication (informed content) before the head cartridge exchange.

In an apparatus wherein the remain indicating portion is not discretely provided, there can be adopted a control construction in which if after the confirmation of head cartridge exchange, the kind of the mounted head cartridge differs, a message to the effect that the kind of the head cartridge has been changed is outputted as shown in the process of a step S507 and the procedure from the step S504 is repeated.

As described above, after the user has been made to confirm the remain, i.e., the informed content, after the exchange for a new head cartridge, selection for initializing or changing the counted value is effected, whereby when the user has become aware of the error of the head cartridge exchange at a stage before the selection, the values of the counted values RMD11 and RCD11 are not initialized or changed and therefore, it becomes possible to restore the remain indication or the like to that before the exchange. Thus, even when the exchange of the head cartridge has been done erroneously, the ink remain in the previously used head cartridge can be grasped accurately.

The present invention can assume the following other forms, besides the above-described embodiment.

Second Embodiment

Figure 7:
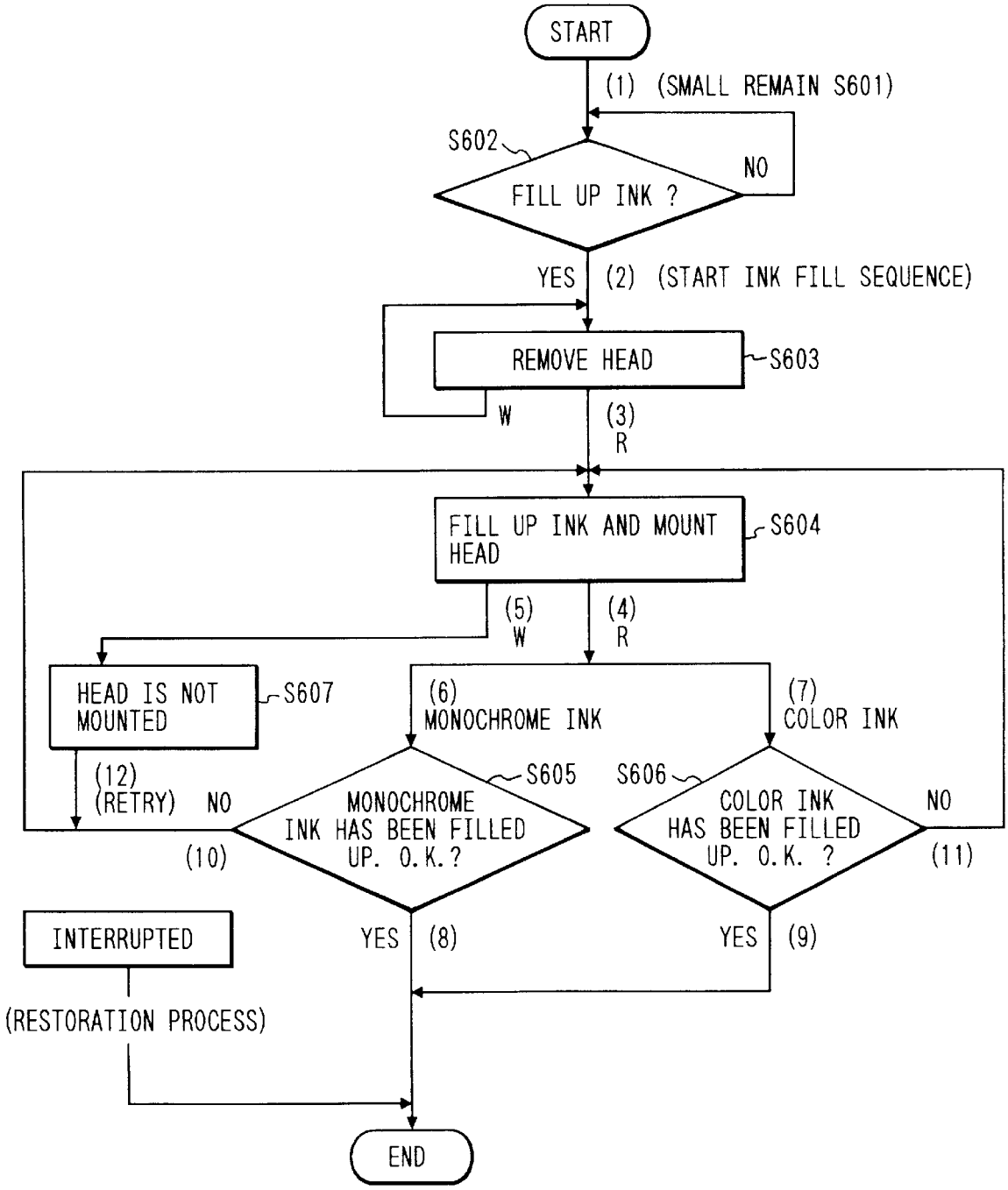
FIG. 7 is a flow chart showing an example of the instruction procedure to the user and the internal control sequence during the use of a recording head in a permanent form in a second embodiment of the present invention.

The above embodiment has been described with respect to the case of a head cartridge in which the recording head and the ink tank are formed integrally with each other, but the present invention can be likewise applied to ink replenishment in the construction of a recording head in a form wherein an ink tank discrete from a recording head is replenished with ink, i.e., a so-called permanent form. FIG. 7 is a flow chart showing an example of the instruction procedure to the user when use is made of a recording head in the permanent form according to the present embodiment and the internal control sequence, and is similar to the procedure shown in FIG. 5.

Third Embodiment

The present invention can also be applied to a case where the recording material is a recording medium such as recording paper or recording sheets. That is, the present invention can also be applied to a recording apparatus of a control type in which the recording apparatus is provided with a plurality of kinds of recording mediums by a self-contained cassette system or the like and the recording capacity, i.e., the number, of these recording mediums is controlled.

Figure 8:
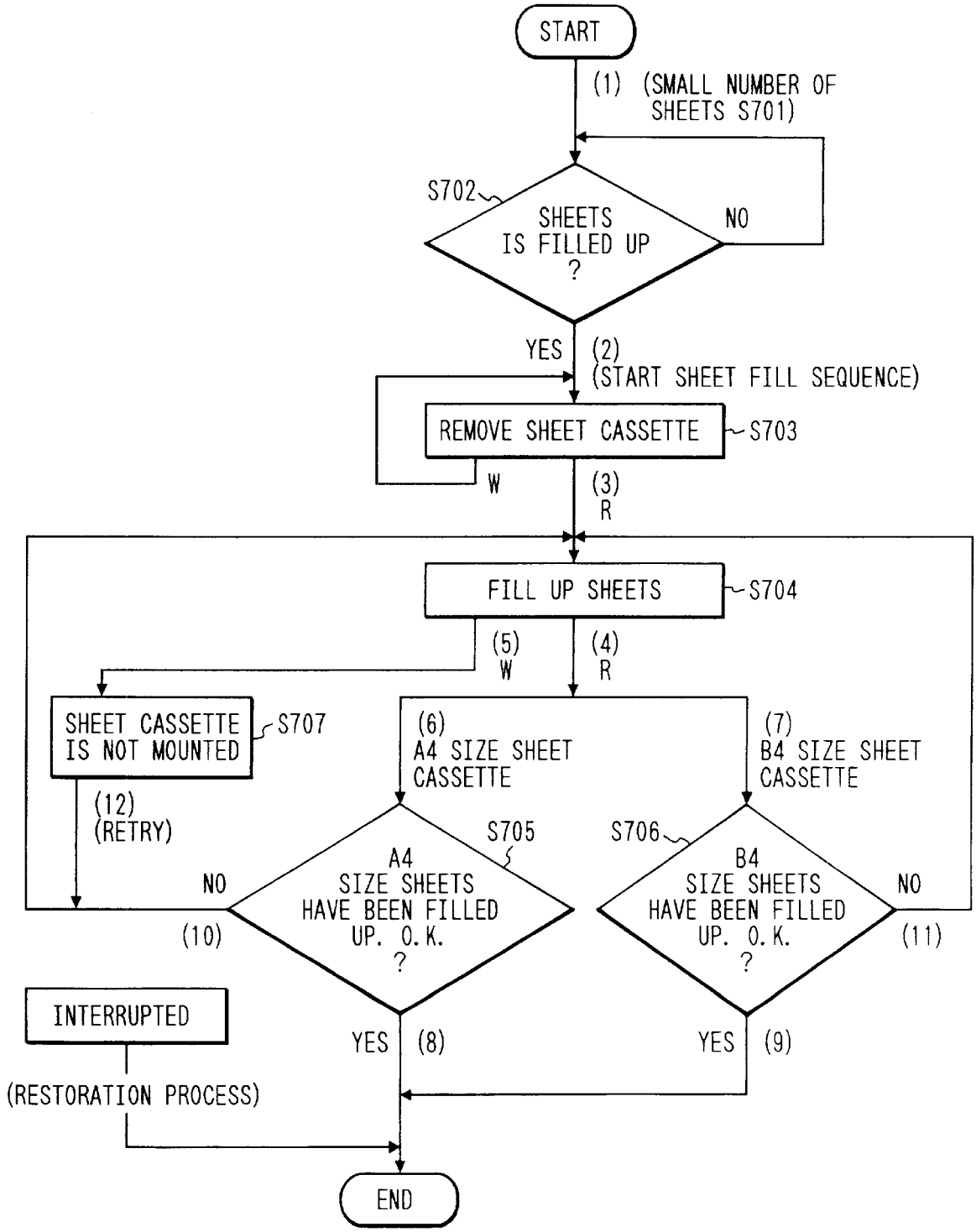
FIG. 8 is a flow chart showing an example of the instruction procedure to the user and the interval control sequence when the recording member in a third embodiment of the present invention is a recording medium.

FIG. 8 is a flow chart showing an example of the instruction procedure to the user when the recording material in this embodiment is a recording medium and the internal control sequence. FIG. 8 shows the sequence when the recording apparatus is provided with two kinds of recording mediums, i.e., A4 size and B4 size recording mediums.

By the above-described construction, even if in a recording apparatus of a control type in which the recording apparatus is provided with a plurality of kinds of recording mediums by a self-contained cassette system or the like and the recording capacity, i.e., the number, of these recording mediums is controlled, the recording mediums are exchanged, the number of the recording mediums can be rightly controlled.

Fourth Embodiment

Figure 9:
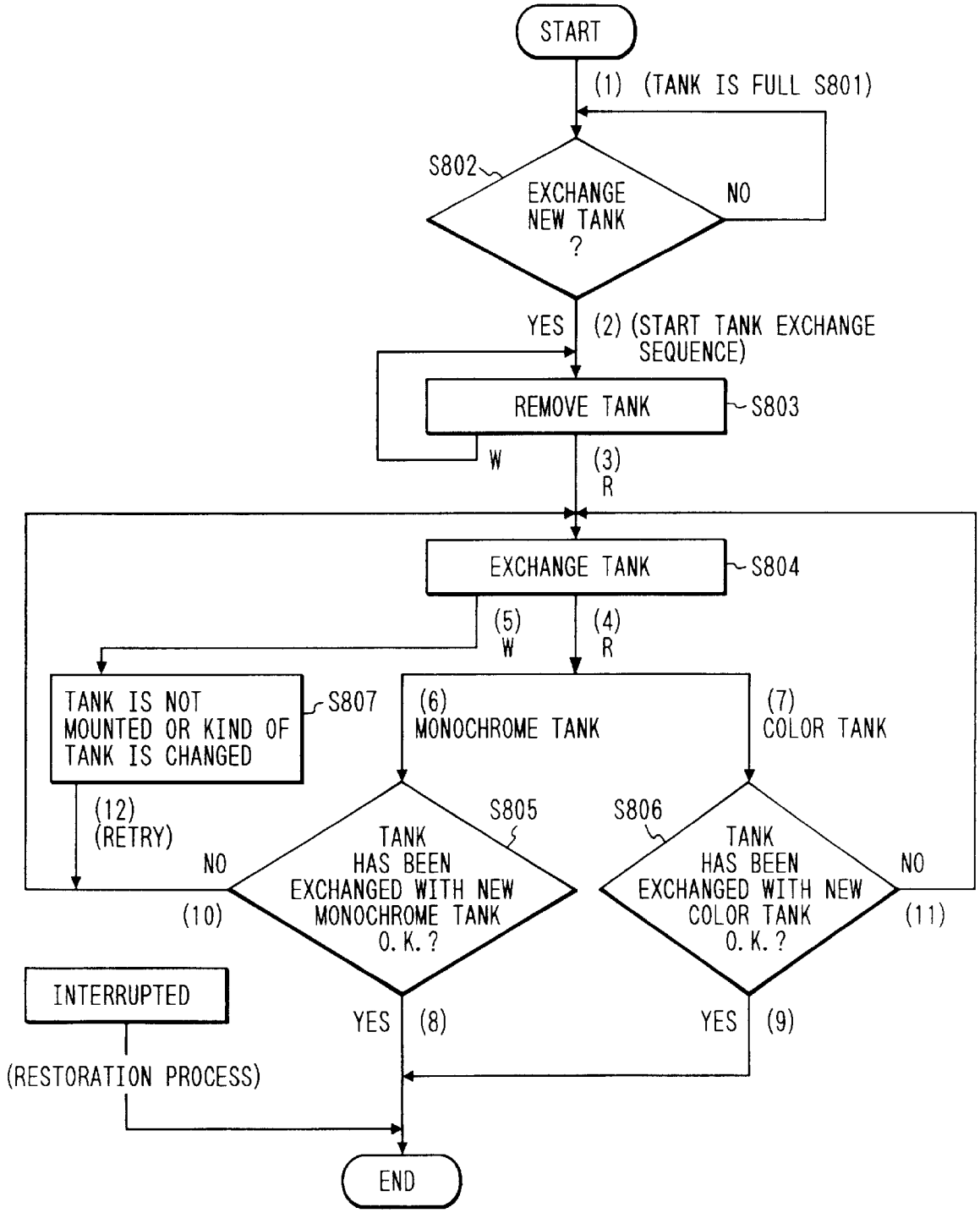
FIG. 9 is a flow chart showing an example of the instruction procedure to the user and the interval control sequence when the recording member in a fourth embodiment of the present invention is a waste ink tank.

The present invention can also be applied to the exchange control of a waste ink tank for storing therein waste ink as a recording material. The waste ink tank stores therein ink discharged from a recording head in an ink jet recording apparatus in the discharge recovering process of the recording head. Accordingly, when the discharged ink is stored over a predetermined amount, the exchange of the waste ink tank becomes necessary so that the ink may not overflow from the waste ink tank. The present embodiment relates to a recording apparatus in which, as in the above-described embodiments, the ink tank for monochrome and the ink tank for color are independent waste ink tanks, and FIG. 9 shows an example of the instruction procedure in such exchange control to the user and the internal control sequence. When in the discharge recovering process, the discharge of the ink is forcibly effected by the suction of a pump, the amount of discharged ink can be estimated by the frequency of driving of the pump. Also, when the head is driven to thereby discharge the ink therefrom and effect recovery, the amount of discharged ink can be estimated on the basis of the frequency of driving of the head. Thus, the frequency of driving of the pump or the frequency of driving of the head can be counted in conformity with the discharge recovering process to thereby estimate the amount of ink discharged into the waste ink tank. The principle of the processing procedure in FIG. 9 is also similar to that of the procedure shown in FIG. 5 and therefore need not be described.

By the above-described construction, the exchange of the waste ink tank can be rightly controlled in the construction provided with waste ink tanks for monochrome and for color.

Fifth Embodiment

Also, in each of the above-described embodiments, one RAM area and one EEPROM are only prepared for each of a monochrome head cartridge and a color head cartridge in the recording apparatus and therefore, when use is made of a plurality of head cartridges of the same kind or other head cartridges of the same kind already used several times than a new head cartridge, it is impossible to grasp an accurate remain in each individual head cartridge. However, in the case of an apparatus having a sufficient RAMEEPROM area, by adopting a construction in which an RAM area and an EEPROM area are prepared for each individual head cartridge and the user selects a head cartridge to be used in the head cartridge exchange process; it becomes possible to recognize an accurate remain even when a plurality of head cartridges of the same kind or other head cartridges of the same kind than a new head cartridge are used many times while being exchanged.

For example, items of head cartridge registration and discrimination are provided in a head cartridge exchange menu to thereby provide a construction in which the user registers head cartridges and indicates the cartridge to be exchanged for during head cartridge exchange, and provide a construction in which the remain in the pertinent head cartridge is indicated in conformity therewith. Unregistered head cartridges are regarded as new cartridges.

Figure 10:
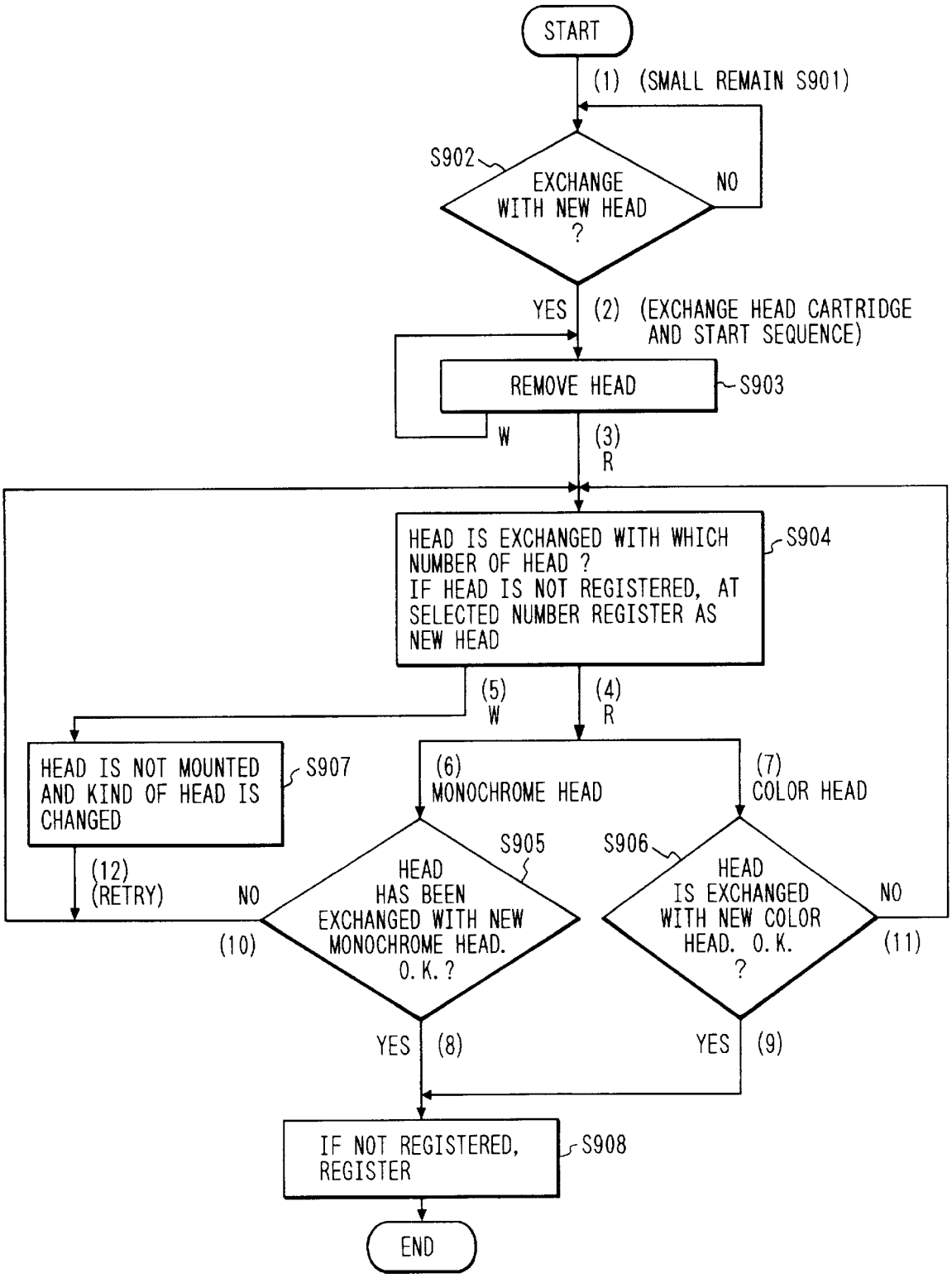
FIG. 10 is a flow chart showing an example of the instruction procedure to the user and the interval control sequence during the use of a plurality of recording heads in a fifth embodiment of the present invention.

FIG. 10 is a flow chart showing an example of the instruction procedure to the user and the internal control sequence during the use of a plurality of head cartridges in the fifth embodiment.

Sixth Embodiment

In the above-described embodiments, MAX remain corresponding to HMAX, i.e., the counted value, is intactly stored in RMDD and RCDD and is used as MAX remain, i.e., the informed content, but in some types of apparatuses, when a head cartridge is exchanged, an exchange process is carried out and the remain decreases slightly. For example, in an ink jet recording apparatus, when a recording head is exchanged, for example, the process of "recording head exchange cleaning" is carried out. This is an operation of discharging or exhausting ink to bring the ink at the end of the discharge port of a new recording head into a stable state. Therefore, in an apparatus wherein an operation of this kind is performed, the remain fluctuates in the case of highly accurate remain indication and a new head cartridge is mounted, and this gives rise to the doubt and dissatisfaction that in spite of the user himself not using the apparatus, the remain is not MAX. To prevent such a problem from arising, the value equivalent to MDD and CDD corresponding to the MAX value in the remain indication, i.e., the informed content is defined in advance as the value of HMAX minus the amount of ink Δ consumed by the above-mentioned "recording head exchange cleaning", whereby there can be made a control construction in which the amount of ink consumed by the "recording head exchange cleaning" is not reflected in the informed content.

Figure 11:
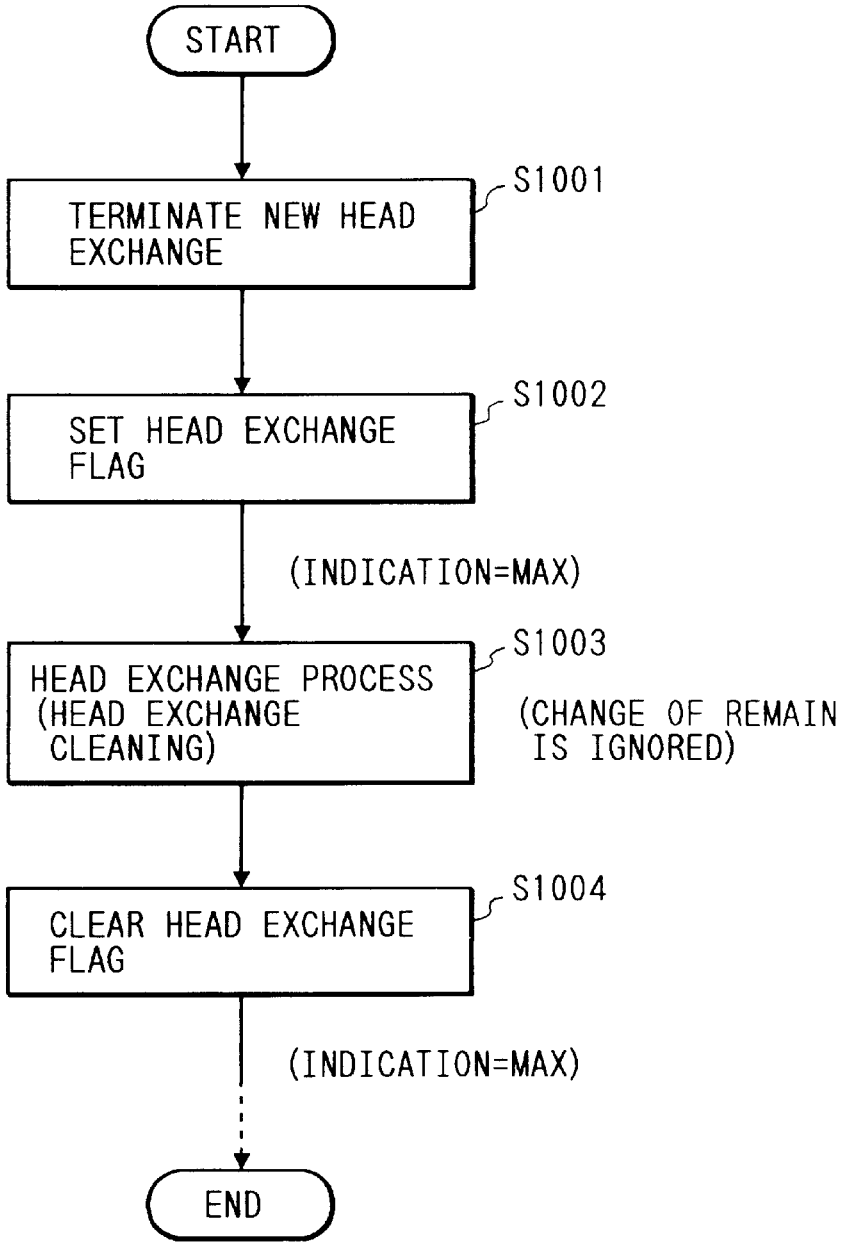
FIG. 11 is a flow chart showing the epitome of the operation of a sixth embodiment of the present invention.

FIG. 11 is a flow chart showing the instruction procedure and the internal control sequence in the present embodiment.

For example, in FIG. 11, when the head cartridge exchange sequence is terminated, a recording head exchange flag prepared in RAM 3104 is stood up (step S1002). Thereafter, recording head exchange cleaning is effected, and when it is terminated, the recording head exchange flag is cleared (step S1004). If this recording head exchange flag is standing, it will become possible to solve the above-noted problem if such control that will ignore the fluctuation of the remain in the operation during that time is effected.

Other Embodiments

Each of the above embodiments has been described with respect to the exchange control for a recording material, but even when a plurality of recording materials are combined together, the present control system can be independently carried out for each of those recording materials.

Also, in the above-described embodiments, the system of indication to the indicating device is adopted as the informing means, but in the case of an apparatus having means for converting informed content into sound and means for generating sound, it becomes possible to adopt a form in which the informed content is given in the form of sound.

The present invention brings about an excellent effect particularly in a recording head and a recording apparatus head and a recording apparatus of a type, among the ink jet recording types, which is provided with means generating heat energy as energy utilized to effect ink discharge (for example, an electro-thermal conversion member, a laser beam or the like) and in which a change in the state of ink is caused by the heat energy. This is because according to such a type, the high density and high minuteness of recording can be achieved.

As regards its typical construction and principle, apparatuses using the basic principle disclosed, for example, U.S. Pat. Nos. 4,723,129 and 4,740,796 are preferable. This system is applicable to both of the so-called on-demand type and continuous type, and particularly in the case of the on-demand type, it is effective because at least one driving signal corresponding to recording information and providing a rapid temperature rise exceeding nuclear boiling is applied to an electro-thermal conversion member disposed correspondingly to a sheet or a liquid path retaining liquid (ink) therein, whereby heat energy is created in the electro-thermal conversion member and film boiling is created in the heat-acting surface of a recording head with a result that a bubble in the liquid (ink) corresponding at one to one to this driving signal can be formed. By the growth and contraction of this bubble, the liquid (ink) is discharged through a discharge opening to thereby form at least one drop. If this driving signal is made into a pulse-like shape, the growth and contraction of the bubble will take place appropriately on the spot and therefore, the discharge of the liquid (ink) particularly excellent in responsiveness can be accomplished, and this is more preferable. Suitable as this pulse-shaped driving signal is the signal as described in U.S. Pat. Nos. 4,463,359 and 4,345,262. The adoption of the conditions described in U.S. Pat. No. 4,313,124 covering an invention relating to the temperature rise rate of the above-mentioned heat-acting surface could accomplish more excellent recording.

As the construction of the recording head, besides the construction comprising a combination of a discharge port, a liquid path and an electro-thermal conversion member (a straight liquid flow path or a right-angled liquid path) as disclosed in each of the above-mentioned patents, the construction using U.S. Pat. Nos. 4,558,333 and 4,459,600 which disclose a construction in which the heat-acting surface is disposed in a bent area is also covered by the present invention. In addition, the present invention is also effective when adoption is made of a construction based on Japanese Laid-Open Patent Application No. 59-123670 which discloses a construction in which a slit common to a plurality of electro-thermal conversion members is used as the discharge portion of the electro-thermal conversion members or Japanese Laid-Open Patent Application No. 59-138461 which discloses a construction in which an opening for absorbing the pressure wave of heat energy corresponds to a discharge portion. This is because whatever may be the form of the recording head, according to the present invention, recording becomes capable of being effected reliably and efficiently.

Further, the present invention can also be effectively applied to a recording head of the full line type having a length corresponding to the maximum width of recording mediums on which the recording apparatus can record. Such a recording head may adopt any of a construction which satisfies that length by a combination of a plurality of recording heads and a construction as a single recording head formed as a unit.

In addition, the present invention is also effective when use is made of a recording head of the serial type as described above, or a recording head fixed to the apparatus body, or a recording head of the exchangeable chip type becoming capable of being electrically connected to and being supplied with ink from the apparatus body by being mounted on the apparatus body, or a recording head of the cartridge type in which an ink tank is provided integrally with the recording head itself.

Also, as the construction of the recording apparatus of the present invention, the addition of discharge recovery means for the recording head, preliminary auxiliary means, etc. could more stabilize the effect of the present invention, and this is preferable. Specifically mentioning these, mention can be made of capping means for the recording head, cleaning means, pressing or sucking means, pre-heating means using an electro-thermal conversion member or a heating element discrete therefrom or a combination of these to effect heating, and preliminary discharge means for effecting discharge discrete from recording.

Also, as regards the kind or number of the carried recording heads, use may be made of a single recording head corresponding, for example, to monochromatic ink, or a plurality of recording heads corresponding to a plurality of inks differing in recording color or density. That is, for example, the recording mode of the recording apparatus is not emitted to the recording mode of a main current color such as black, but use may be made of a recording head constructed as a unit or a combination of a plurality of recording heads, and the present invention is also very effective for an apparatus provided with at least one of recording modes of plural different colors or full color by mixed colors.

Further, in the above-described embodiments of the present invention, the ink has been described as liquid, but use may be made of ink which solidifies at room temperature or below and softens or liquefies at room temperature, or ink which assumes a liquid state when a recording signal in use is imparted thereto, because in the ink jet systems, it is usual to temperature-control ink itself within a range of 30° C. to 70° C. to thereby temperature-control the ink so that the viscosity of the ink may be within a stable discharge range. In addition, in order to cause the temperature rise by heat energy to be used as energy for the state change from the solid state of ink to the liquid state to thereby positively prevent the temperature rise, or to present the evaporation of the ink, use may be made of ink which solidifies when left as it is and is liquefied by heating. In any case, the present invention is also applicable when use is made of ink of the nature which is liquefied only by the imparting of heat energy thereto, such as ink which is liquefied by the imparting of heat energy conforming to a recording signal and is discharged as liquid ink, or ink which already begins to solidify at a point of time whereat it arrives at a recording medium. The ink in such a case may be in such a form as described in Japanese Laid-Open Patent Application No. 54-56847 or Japanese Laid-Open Patent Application No. 60-71260 wherein the ink is held as liquid or a solid in porous sheet recesses or through-holes and is opposed to an electro-thermal conversion member. In the present invention, what is most effective for each of the above-described inks is that which executes the above-described film boiling system.

Furthermore, the forms of the ink jet recording apparatus of the present invention may be a form used as the image output terminal of an information processing apparatus such as a computer, the form of a copying apparatus combined with a reader or the like, and the form of a facsimile apparatus having the signal transmitting and receiving functions.

As is apparent from the foregoing description, according to the present invention, when recording material holding means such as a head cartridge has been exchanged, the memory content regarding the amount of the recording material held by the thitherto used recording material holding means is not immediately changed, but is changed in accordance with the amount of recording material in new holding means only when the user becomes aware of erroneous mounting by informed content and the input after the confirmation of the mounting of right holding means is done.

As a result, even when the mounting of a wrong cartridge or the like has been done, it becomes possible to confirm the remain of a recording material such as ink until then.

What is claimed is:

1. A recording apparatus operable with recording means for recording with a recording material, the recording apparatus comprising:

recording material holding means for holding therein a recording material to be consumed by recording in said recording apparatus, said recording material holding means being removably mounted in said recording apparatus;

detecting means for detecting an amount of the recording material held in said recording material holding means mounted in said recording apparatus;

memory means for memorizing the amount of the recording material in accordance with a result detected by said detecting means;

notifying means for notifying a user of information regarding the amount of a recording material held by said recording material holding means;

input means for enabling a user to effect predetermined inputting; and changing means for causing said notifying means to notify the user when said recording material holding means is mounted in the recording apparatus and for causing the content memorized by said memory means to be changed in response to said input means effecting the predetermined inputting.

2. A recording apparatus according to claim 1, further comprising informing means for informing the user of the amount of the recording material held in said recording material holding means in accordance with the content memorized by said memory means, said informing means being effective to inform the user of the amount of the held recording material when said recording material holding means is mounted, and to inform the user of the amount memorized by said memory means after the predetermined inputting has been effected by said input means.

3. A recording apparatus according to claim 1, further comprising used-amount detecting means for detecting a used amount of the recording material held in said recording material holding means mounted in said recording apparatus, said detecting means being effective to detect the amount held in said recording material holding means on the basis of the used amount detected by said used-amount detecting means.

4. A recording apparatus according to claim 1, wherein said recording material is comprised by toner to be adhered onto a recording medium by said recording means.

5. A recording apparatus according to claim 1, wherein said recording material is comprised by a recording medium on which recording is to be effected by said recording means.

6. A recording apparatus according to claim 1, wherein said recording material is comprised by a plurality of recording materials.

7. A recording apparatus according to claim 1, wherein said recording means comprises an ink jet recording head including discharging means for discharging ink.

8. A recording apparatus according to claim 7, wherein said recording material holding means is comprised by an ink reservoir for holding ink therein and for supplying the ink to said recording head.

9. A recording apparatus according to claim 8, wherein the ink jet recording head and the ink reservoir are formed integrally with each other and together comprise said recording means.

10. A recording apparatus according to claim 7, wherein said recording material holding means is comprised by waste ink holding means for holding therein ink discharged from said ink jet recording head as ink not used for recording.

11. A recording apparatus according to claim 7, wherein said discharging means is comprised by a heat generating element for applying heat energy to the ink, for creating a bubble in the ink by said heat energy, and for discharging the ink on the basis of the creation of said bubble.

12. A method of notifying a user of a remaining amount of a consumable recording material in a recording apparatus provided with recording means for recording with the recording material, and removably provided with recording material holding means holding therein the recording material, the method comprising the steps of:

prompting a user for removal of said recording material holding means from said recording apparatus;

notifying the user of information regarding a remaining amount of recording material held by the recording material holding means;

notifying the user when said recording material holding means is mounted on the recording apparatus; and changing a content of memory means for memorizing the information regarding a remaining amount of recording material when the user has effected a predetermined inputting.

13. A method according to claim 12, further comprising the steps of:

indicating the amount of the recording material remaining in said recording material holding means; and clearing the information about the remaining amount of recording material in said recording material holding means which is used for the indication at said indicating step when said recording material holding means has been removed.

14. A method according to claim 12, wherein when the user inputs instructions for interruption, said step of changing a content of a memory means is not effected.

15. A method according to claim 12, further comprising the step of providing said recording material comprised by ink to be applied onto a recording medium by said recording means.

16. A method according to claim 12, further comprising the step of providing said recording material comprised by a toner to be adhered onto a recording medium by said recording means.

17. A method according to claim 12, further comprising the step of providing said recording material comprised by a recording medium on which recording is to be effected by said recording means.

18. A method according to claim 12, further comprising the step of providing said recording material comprised by a plurality of recording materials.

19. A method according to claim 12, further comprising the step of providing said recording means comprised by ink jet recording head including discharging means for discharging ink.

20. A method according to claim 19, further comprising the step of providing said recording material holding means comprised by an ink reservoir for holding ink therein and for supplying the ink to said recording head.

21. A method according to claim 20, further comprising the step of providing the ink jet recording head and the ink reservoir formed integrally with each other, together comprising said recording means.

22. A method according to claim 19, further comprising the step of providing said recording material holding means comprised by waste ink holding means for holding therein ink discharged from said ink jet recording head as ink not used for recording.

23. A method according to claim 19, further comprising the step of providing said discharging means comprised by a heat generating element for applying heat energy to the ink, for creating a bubble in the ink by said heat energy, and for discharging the ink on the basis of the creation of said bubble.

* * * * *